US011741911B2

(12) United States Patent
Pyeon

(10) Patent No.: US 11,741,911 B2
(45) Date of Patent: Aug. 29, 2023

(54) DISPLAY DEVICE AND DRIVING METHOD FOR THE SAME

(71) Applicant: LG DISPLAY CO., LTD., Seoul (KR)

(72) Inventor: Myungjin Pyeon, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/887,006

(22) Filed: Aug. 12, 2022

(65) Prior Publication Data

US 2023/0135983 A1 May 4, 2023

(30) Foreign Application Priority Data

Oct. 28, 2021 (KR) ..... 10-2021-0145341

(51) Int. Cl.
*G09G 3/3291* (2016.01)

(52) U.S. Cl.
CPC ... *G09G 3/3291* (2013.01); *G09G 2300/0842* (2013.01); *G09G 2310/0272* (2013.01)

(58) Field of Classification Search
CPC ..... G09G 3/3233; G09G 3/20; G09G 3/3648; G09G 3/006; G09G 3/3275; G09G 3/3291; G09G 3/3688; G09G 3/3258; G09G 2310/08; G09G 2310/0297; G09G 2300/0426; G09G 2300/0842; G09G 2300/0819; G09G 2320/0295; G09G 2320/045; G09G 2320/0233; G09G 2320/043; G09G 2320/029
See application file for complete search history.

(56) References Cited

U.S. PATENT DOCUMENTS

2016/0071445 A1* 3/2016 Kim ..... G09G 3/3291 345/212
2019/0035331 A1* 1/2019 Do ..... G09G 3/3233

FOREIGN PATENT DOCUMENTS

KR 2017-0003841 A 1/2017
KR 20170076953 A * 7/2017 ..... G09G 3/32
KR 2019-0012049 A 2/2019
KR 10-2021-0150737 A 12/2021

OTHER PUBLICATIONS

GB Office Action dated Mar. 20, 2023 issued in Patent Application No. GB2214054.5 (6 pages).

* cited by examiner

*Primary Examiner* — Dong Hui Liang
(74) *Attorney, Agent, or Firm* — POLSINELLI PC

(57) ABSTRACT

A display device includes a display panel with unit-pixels disposed thereon, each of the unit-pixels being formed of a plurality of pixels; a data driver applying data voltage to the plurality of pixels during a display period and applying sensing data voltage to the plurality of pixels during a sensing period; a sensing unit sensing an electrical characteristic of the plurality of pixels during the sensing period; and an external compensation unit compensating for the data voltage based on a result of the sensing.

13 Claims, 8 Drawing Sheets

DISPLAY DEVICE AND DRIVING METHOD FOR THE SAME

CROSS-REFERENCE TO RELATED APPLICATION

The present application claims the priority of Korean Patent Application No. 10-2021-0145341, filed on Oct. 28, 2021, which is hereby incorporated by reference in its entirety.

BACKGROUND

Field of the Disclosure

The present disclosure relates to a display device and a driving method for the same.

Description of the Background

An organic light emitting display (OLED) is actively used because of lightness, thin shape and low power consumption as well as an excellent image quality. However, such organic light emitting display device has a problem that luminance decreases as a threshold voltage of a driving transistor thereof is shifted and a luminance difference among pixels is recognized as a smudge.

In order to resolve the problem, studies regarding various algorithms of compensation that senses a threshold voltage of the driving transistor and compensates for a threshold voltage is underway.

SUMMARY

Accordingly, the present disclosure is to provide a display device capable of sensing and compensating for deterioration of the driving transistor and a driving method of the same.

In addition, the present disclosure is to provide a display device that performs pixel sensing on a representative pixel inside a pixel unit and compensates the remaining pixels by using an offset value, and a driving method of the display device.

In an aspect of the present disclosure, a display device includes a display panel with unit-pixels disposed thereon, each of the unit-pixels being formed of a plurality of pixels; a data driver applying data voltage to the plurality of pixels during a display period and applying sensing data voltage to the plurality of pixels during a sensing period; a sensing unit sensing an electrical characteristic of the plurality of pixels during the sensing period; and an external compensation unit compensating for the data voltage based on a result of the sensing.

The plurality of pixels disposed in a same row in the display panel and forming a unit-pixel may share one sensing line.

The sensing unit may perform the sensing on each of the plurality of pixels in a first mode and perform the sensing on a representative pixel of the plurality of pixels which is disposed far from the sensing line in a direction of the row in a second mode.

The sensing period may be a turn-on period of an OFFRS signal being generated when power of the display device is turned off.

The sensing unit may perform the sensing according to the first mode if the sensing is performed for the first time, perform the sensing according to the second mode if the sensing is performed not for the first time, and perform the sensing according to the first mode if a predetermined condition is met.

The predetermined condition includes a case that a first predetermined time is elapsed after a last sensing, or a case that a driving time of the display device elapsed a second predetermined time.

The external compensation unit may compensate for the data voltage based on results of sensing each of the plurality of pixels in the first mode, and compensate for the data voltage by using a result of sensing the representative pixel and an offset data corresponding to a difference between an electrical characteristic of the representative pixel and an electrical characteristic of remaining pixels in the second mode.

The display device may include a first memory storing an initial external compensation data of the display device; and a second memory storing an updated external compensation data obtained by summing the sensing result and the initial external compensation data.

The external compensation data may include threshold voltage data of the driving transistor provided in each of the plurality of pixels and an offset data representing a difference in an electrical characteristic of the driving transistors of the plurality of pixels.

In another aspect of the present disclosure, a method of driving a display device includes a display panel, wherein the display panel has unit-pixels disposed thereon, and each of the unit-pixels is formed of a plurality of pixels. The method includes applying data voltage to the plurality of pixels during a display period; applying sensing data voltage to the plurality of pixels during a sensing period; sensing an electrical characteristic of the plurality of pixels based on current outputted from the plurality of pixels in response to the sensing data voltage; and compensating for the data voltage based on the sensing result.

The plurality of pixels disposed in a same row and forming a unit-pixel may share one sensing line.

The sensing an electrical characteristic of the plurality of pixels may include performing the sensing on each of the plurality of pixels in the first mode and performing the sensing on a representative pixel of the plurality of pixels which is disposed far from the sensing line in a direction of the row in the second mode.

The applying the sensing data voltage to the plurality of pixels during the sensing period may include outputting an OFFRS signal at a turn-on level as a response to a power-off request and applying the sensing data voltage to the plurality of pixels while the OFFRS signal is maintained at the turn-on level.

The sensing an electrical characteristic of the plurality of pixels may include determining whether the sensing is performed for the first time or not and proceeding to the first mode if the sensing is performed for the first time.

The sensing an electrical characteristic of the plurality of pixels may include determining whether a predetermined condition is met or not if the sensing is performed not for the first time, proceeding to the second mode if the predetermined condition is not met, and proceeding to the first mode if the predetermined condition is met.

The predetermined condition may include a case that a first predetermined time is elapsed after a last sensing, or a case that a driving time of the display device elapsed a second predetermined time.

The compensating for the data voltage based on the sensing result may include compensating for the data voltage based on results of sensing each of the plurality of pixels in the first mode and compensating for the data voltage by using a result of sensing the representative pixel and an offset data corresponding to a difference between an electrical characteristic of the representative pixel and an electrical characteristic of remaining pixels in the second mode.

The method of driving the display device may further include: storing an initial external compensation data of the display device in a first memory before the applying sensing data voltage to the plurality of pixels during the sensing period; and storing an updated external compensation data obtained by summing the sensing result and the initial external compensation data in a second memory after the sensing an electrical characteristic of the plurality of pixels.

The external compensation data may include threshold voltage data of the driving transistor provided in each of the plurality of pixels and an offset data representing a difference in an electrical characteristic of the driving transistors of the plurality of pixels.

It is to be understood that both the foregoing general description and the following detailed description are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure.

In the drawings.

DETAILED DESCRIPTION

Figure 1:
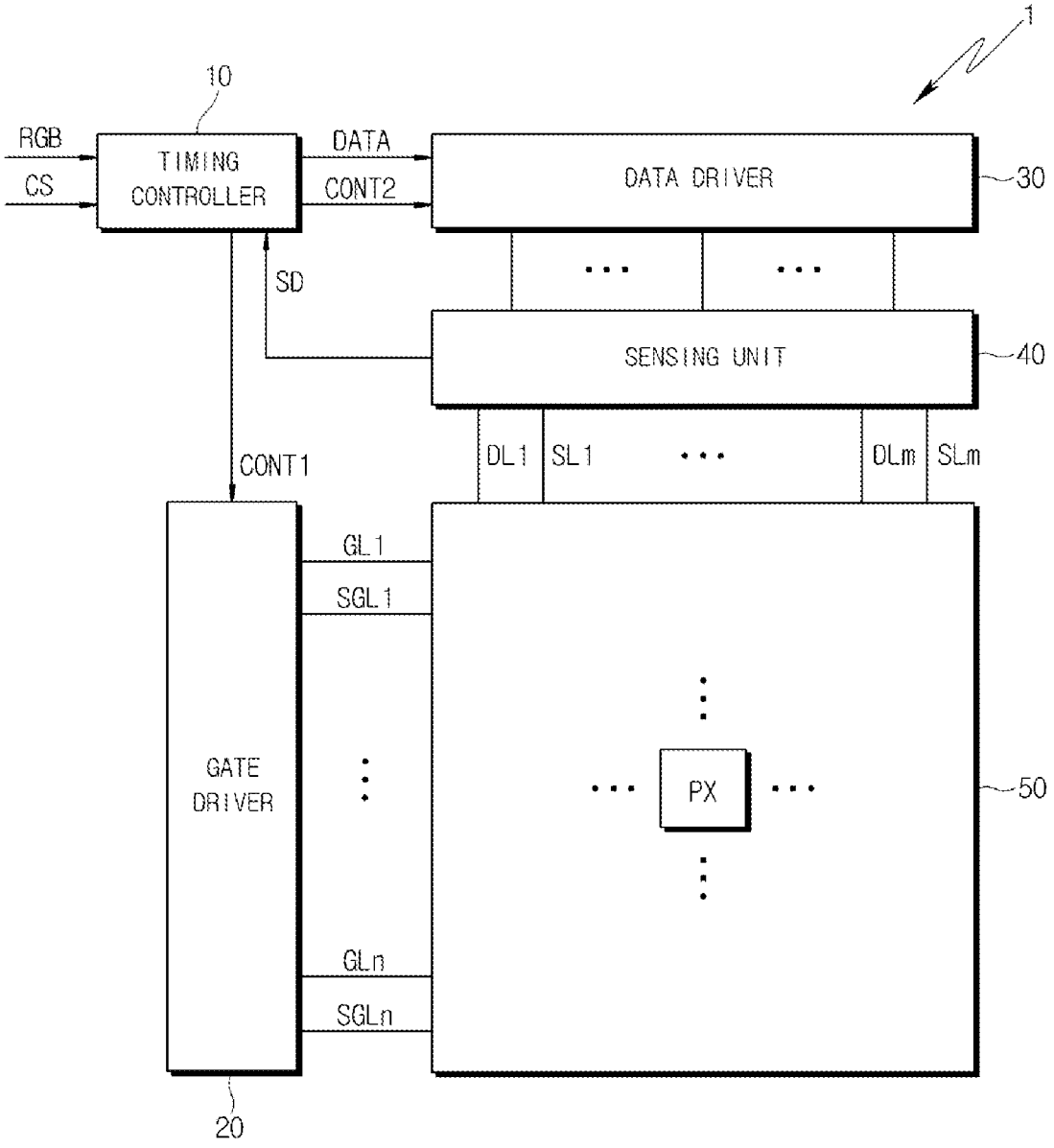
FIG. 1 is a block diagram illustrating configuration of the display device according to an aspect of the present disclosure.

Other details of the aspects are included in the detailed description and accompanying drawings.

The features, advantages and method for accomplishment of the present disclosure will be more apparent from referring to the following detailed aspects described as well as the accompanying drawings. However, the present disclosure is not limited to the aspect to be disclosed below and is implemented in different and various forms. In the below description, when a part is referred to as being "connected to" another part, it can be directly connected to the other part, or it can be electrically connected to the other part with another intervening element inserted therebetween. In addition, parts irrelevant to the present disclosure are omitted in the attached drawings for clarity of description, and like reference numerals denote like elements throughout the attached drawings and the written description.

FIG. 1 is a block diagram illustrating configuration of the display device according to an aspect of the present disclosure.

Referring to FIG. 1, a display device 1 includes a timing controller 10, a gate driver 20, a data driver 30, a sensing unit 40 and a display panel 50.

The timing controller 10 may receive an image signal (RGB) and a control signal (CS) from the outside. The image signal (RGB) may include a plurality of gray-scale data. The control signal (CS) may include, for example, a horizontal synchronous signal, a vertical synchronous signal and a main clock signal.

The timing controller 10 may generate and output video data (DATA), a gate driving control signal (CONT1) and a data driving control signal (CONT2) by processing the image signal (RGB) and the control signal (CS) to be made suitable for operating condition of a display panel 50.

The gate driver 20 may be connected to pixels (PX) of the display panel 50 via a plurality of gate lines (GL1~GLn) and a plurality of sensing gate lines (SGL1~SGLn). The gate driver 20 may generate the gate signals based on the gate driving control signal (CONT1) outputted from the timing controller 10. The gate driver 20 may provide the generated gate signals to the pixels (PX) via a plurality of gate lines (GL1~GLn) and a plurality of sensing gate lines (SGL1~SGLn).

The data driver 30 may be connected to the pixels (PX) of the display panel 50 via a plurality of data lines (DL1~DLm). The data driver 30 may generate data signals by converting video data (DATA) through a digital-to-analogue converter based on the data driving control signal (CONT2) outputted from the timing controller 10.

During a display time of a frame, the data driver 30 may provide the generated data signals to pixels (PX) via a plurality of data lines (DL1~DLm). The data signals may be applied to pixels (PX) of a pixel column selected by the gate signal. To this end, the data driver 30 may supply data signals to a plurality of data lines (DL1~DLm) for synchronization with the gate signals.

In addition, the data driver 30 may output data signals aimed at sensing a threshold voltage of the driving transistor inside a corresponding pixel (PX) to the data lines (DL1~DLm) during a sensing period. The data signals may be applied to the pixels (PX) of a pixel column selected by a sensing gate signal. To this end, the data driver 30 may supply sensing data signals to a plurality of data lines (DL1~DLm) for synchronization with the sensing gate signal.

The sensing unit 40 may receive a sensing signal from pixels (PX) via a plurality of sensing lines (SL1~SLm) and may generate sensing data (SD) which is a digital signal by converting the received sensing signal through an analog-to-digital converter. The sensing unit 40 may provide the sensing data (SD) to the timing controller 10.

The timing controller 10, the gate driver 20, the data driver 30 and the sensing unit 40 each may be configured as a separate Integrated Circuit (IC) or an Integrated Circuit in which at least some of them are integrated together. For example, the sensing unit 40 and the data driver 30 together may be integrated in a driver IC.

On the display panel 50, a plurality of pixels (PX) are disposed. The pixels (PX) may be disposed, for example, in a form of matrix on the display panel 50.

Each of the pixels (PX) may be electrically connected to the corresponding gate line, sensing gate line, data line and sensing line. Such pixels (PX) may be applied with the data signals via the data lines (DL1~DLm) in synchronization with the gate signals applied to the gate lines (GL1~GLn). The pixels (PX) may emit light in a luminance corresponding to the data signals.

Each of the pixels (PX) may display any color among a first to a fourth color. In the aspect, each of the pixels (PX) may display any color among a red, green, blue and white colors. However, the aspect is not limited thereto.

The pixels (PX) may be configured by including a pixel circuit and a light emitting diode. The light emitting diode may emit light in a luminance corresponding to a current amount being controlled by the pixel circuit. The pixel circuit may be configured by including at least one transistor and one storage capacitor.

Figure 2:
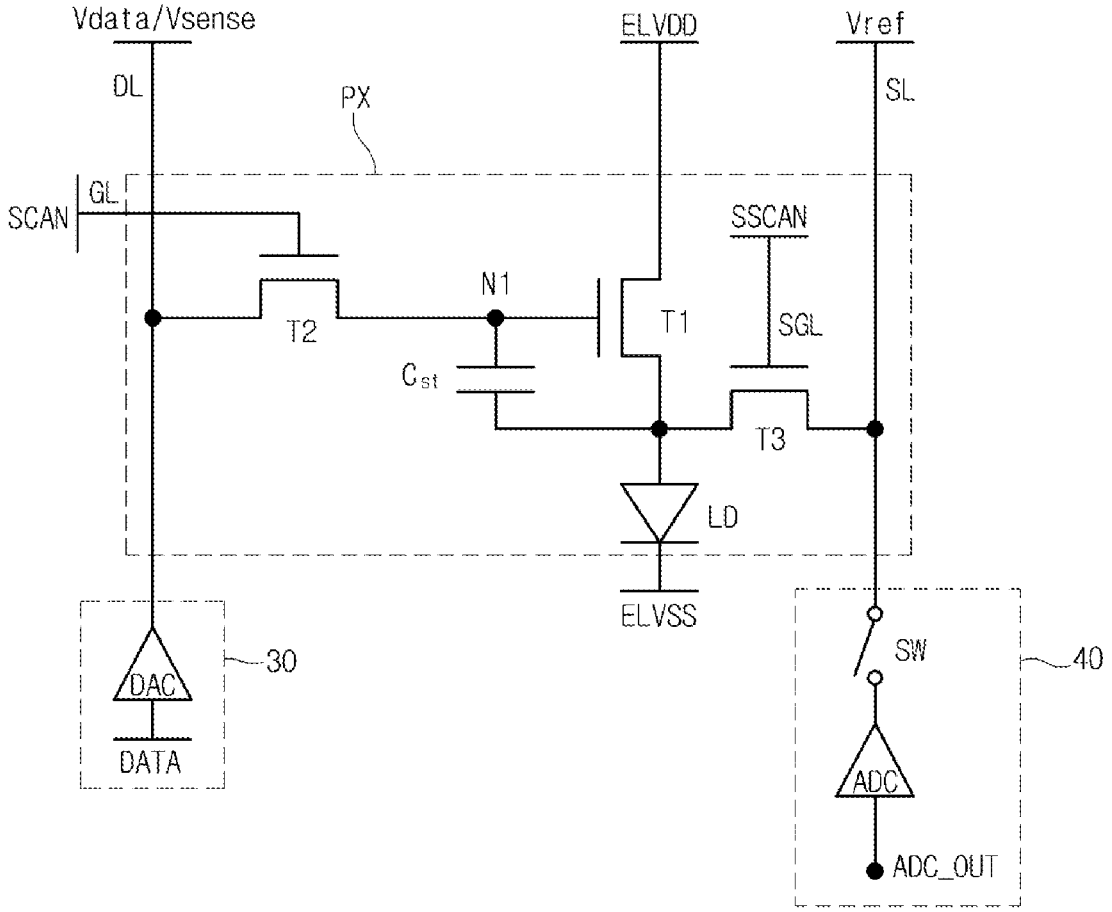
FIG. 2 is a circuit diagram that schematically shows connection relationship among a pixel, a data driver and a sensing unit of the present disclosure.

FIG. 2 is a circuit diagram that schematically shows connection relationship among a pixel, a data driver and a sensing unit of the present disclosure.

Referring to FIGS. 1 and 2, each of the pixels (PX) may include a plurality of transistors and the light emitting diode driven by the plurality of transistors. In the aspect, the pixels (PX) may include the data line (DL), the sensing line (SL), the gate line (GL), the sensing gate line (SGL), a first transistor (T1), the light emitting diode (LD), a second transistor (T2), the storage capacitor (Cst) and a third transistor (T3).

The data line (DL) is connected to an output port of the data driver 30 and delivers data voltage (Vdata) to the pixels (PX).

The sensing line (SL) is connected to the sensing unit 40. During the sensing period, the sensing line (SL) may deliver a reference voltage (Vref) to the pixels (PX) and may deliver the sensing signal generated in the pixels (PX) to the sensing unit 40.

The gate line (GL) may be connected to an output port of the gate driver 20. The gate line (GL) delivers the gate signal (SCAN) generated in the gate driver 20 to the pixels (PX). The gate signal (SCAN) includes a section that turns on the second transistor (T2).

The sensing gate line (SGL) is connected to an output port of the gate driver 20. The sensing gate line (SGL) delivers the sensing gate signal (SSCAN) generated in the gate driver 20 to the pixels (PX). The sensing gate signal (SSCAN) includes a section that turns on the third transistor (T3).

The first transistor (T1) includes a gate electrode connected to the storage capacitor (Cst), a first electrode receiving a first power voltage (ELVDD) and a second electrode connected to an anode electrode of the light emitting diode (LD). The first transistor (T1) may be referred to as the driving transistor.

The light emitting diode (LD) includes the anode electrode connected to the second electrode of the first transistor (T1) and a cathode electrode receiving the second power voltage (ELVSS).

The second transistor (T2) includes the gate electrode connected to the gate line (GL), the first electrode connected to the data line (DL) and the second electrode connected to the gate electrode of the first transistor (T1). According to control of the gate signal (SCAN), the second transistor (T2) may provide the data voltage (Vdata) to the gate electrode of the first transistor (T1). In other words, the second transistor (T2) may be disposed between the data line (DL) and the gate electrode of the first transistor (T1) and may be turned on or off by the control of the gate signal (SCAN).

The storage capacitor (Cst) includes the second electrode connected between the first electrode connected to the gate electrode of the first transistor (T1) and the anode electrode (the second electrode of the first transistor (T1)) of the light emitting diode (LD).

The third transistor (T3) includes the gate electrode connected to the sensing gate line (SGL), the first electrode connected to the second electrode of the first transistor (T1) and the second electrode connected to the sensing line (SL). According to the control of the sensing gate signal (SSCAN), the third transistor (T3) may deliver information of currents flowing in the driving transistor or information of voltages of the anode electrode to the sensing unit 40 via the sensing line (SL). The third transistor (T3) may be disposed between the second electrode of the driving transistor and the sensing line (SL) and may be turned on or off by the control of the sensing gate signal (SSCAN).

The data driver 30 may generate the data voltage (Vdata) by converting the video data (DATA) using a digital-to-analog converter (DAC). In addition, the data driver 30 may output the sensing data voltage (Vsense) to sense a threshold voltage of the first transistor (T1) inside a corresponding pixel to the data line (DL).

The sensing unit 40 may include the analog-to-digital converter (ADC) generating the sensing data (SD) after converting the sensing signal from analog to digital. The sensing unit 40 may include a switching element (SW) connected between the sensing line (SL) and the analog-to-digital converter (ADC). The switching element (SW) may connect the sensing line (SL) and the analog-to-digital converter (ADC) according to a sampling signal.

The timing controller 10 may calculate the external compensation data, for example, threshold voltage compensation value of the driving transistor, to compensate for deterioration of pixels (PX) based on the sensing data (SD) generated in the sensing unit 40 and generate a calibrated video data (DATA) based on the calibrated value.

Figure 3:
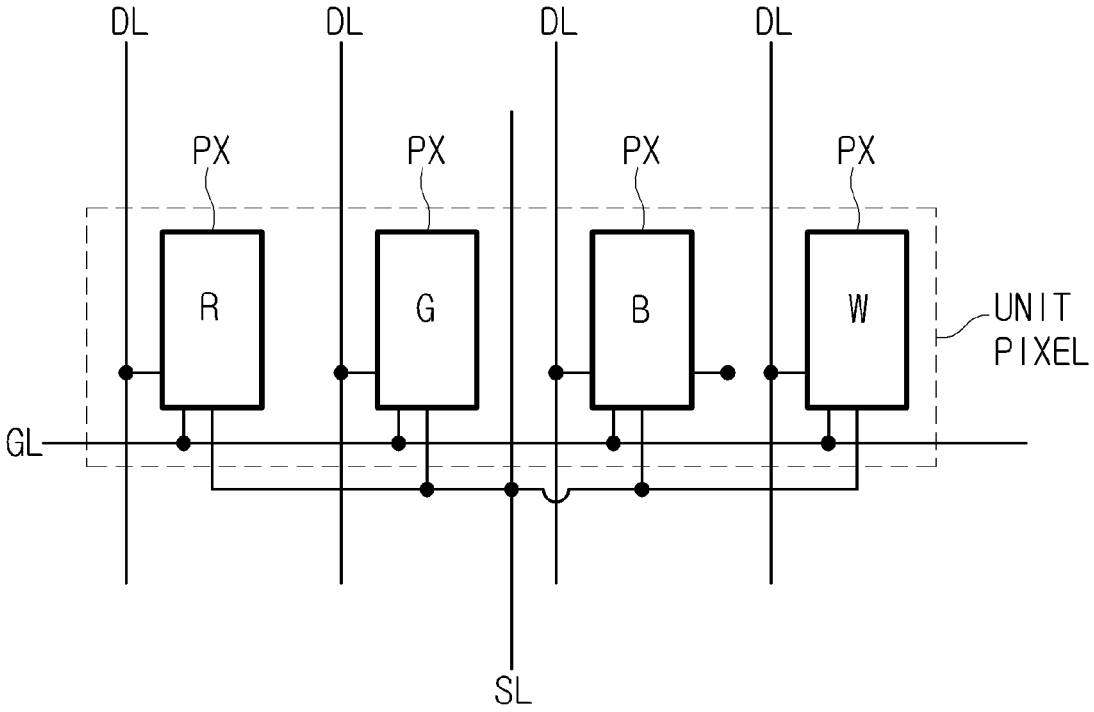
FIG. 3 is a circuit diagram that schematically shows connection relationship of pixels according to an aspect of the present disclosure.

FIG. 3 is a circuit diagram that schematically shows connection relationship of pixels according to an aspect of the present disclosure.

Referring to FIGS. 1 to 3, the data lines (DL1~DLm) and the gate lines (GL1~GLn) crossing each other are disposed on the display panel 50, and the pixels (R, G, B, W) are disposed in an area where the data lines (DL1~DLm) and the gate lines (GL1~GLn) cross each other.

In the aspect, the pixels (PX) of various different colors may constitute a single unit-pixel to display a variety of colors. For example, the unit-pixel may include the a red (R), green (G), blue (B), and white (W) pixels that are neighbored with each other in a row direction. Each of the pixels (R, G, B, W) may be connected to the corresponding data line (DL) and gate line (GL).

The display panel 50 includes the sensing line (SL) connected to the pixels (R, G, B, W). The sensing line (SL) not only may apply the reference voltage (Vref) to the pixels (R, G, B, W), but also be used to sense change in an electrical characteristic of the pixels (R, G, B, W), for example, a degree of deterioration.

The sensing line (SL) may take the form of a shared structure being shared by the pixels (R, G, B, W) forming a unit-pixel. For example, the pixels (R, G, B, W) that are disposed on the same pixel row and form a unit-pixel may share one sensing line (SL) with each other.

Figure 4:
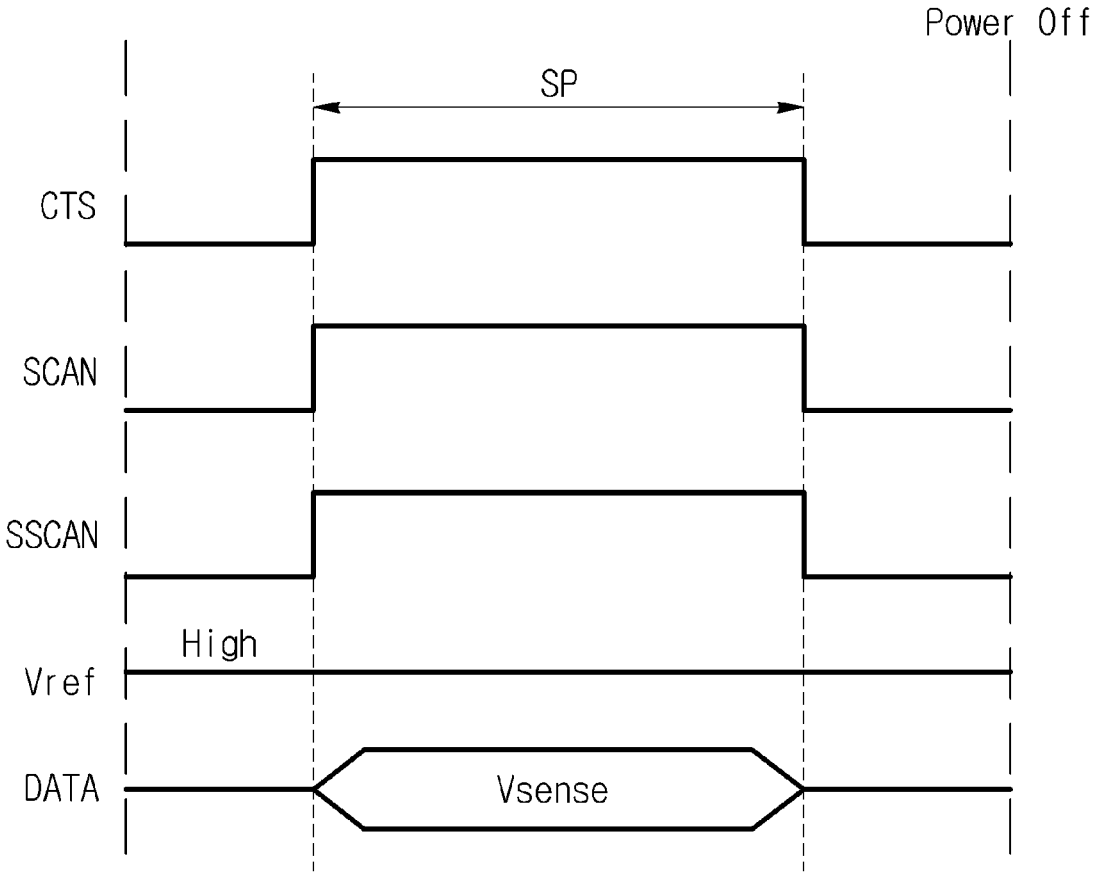
FIG. 4 is a timing diagram that shows driving method of the display device according to an aspect of the present disclosure.

FIG. 4 is a timing diagram that shows driving method of the display device according to an aspect of the present disclosure.

The display device 1 may operate in a display mode displaying an image during a display period, and operate in a sensing mode sensing change in an electrical characteristic of the pixels (R, G, B, W) during a sensing period. The sensing period may be conducted during a power-on sequence period before an image is displayed, or during a power-off sequence period after display of an image is finished. The power-on sequence period refers to a period that begins after a system is powered on and ends by the time an image is displayed. The power-off sequence period refers to a period that begins after display of an inputted image is finished and ends by the time the system is powered off. The power-off sequence period is illustrated in FIG. 4 as an example.

The power-off period may include the sensing period (SP). The sensing period (SP) may be instructed by a control signal (CTS) applied by the timing controller 10 to the data driver 30, the sensing unit 40 and the like. The control signal (CTS) may be, for example, an OFFRS (offset reference signal) signal generated when the display device 1 is being powered off, and when the OFFRS signal is at a turn-on level (for example, a high level), the display device 1 may operate in the sensing period (SP).

During the sensing period (SP), the gate signal (SCAN) and the sensing gate signal (SSCAN) at a gate-on level may maintain the gate-on level and respond to the gate signal (SCAN) and the sensing gate signal (SSCAN), thereby the second transistor (T2) and the third transistor (T3) are turned on. The sensing data voltage (Vsense) is supplied to the gate electrode of the first transistor (T1) and the reference voltage (Vref) is supplied to the second electrode. In the aspect, the sensing data voltage (Vsense) may be a black data voltage, but is not limited thereto.

While an electric potential of the anode electrode of the light emitting diode (LD) is maintained as a constant voltage, a current of the driving transistor flowing depending on a voltage difference between a voltage of the gate electrode of the first transistor (T1) and a voltage of the second electrode may flow to the sensing line (SL). The sensing unit 40 may generate the sensing data (SD) by sensing a current flowing to the sensing line (SL).

In the aspect, the sensing period (SP) may be defined as a period during which information on deterioration (for example, the threshold voltage) of the first transistor (T1), in other words, the driving transistor inside the pixels (R, G, B, W) is sensed.

In various aspects, the display device 1 may perform sensing on each of the pixels, red (R), green (G), blue (B) and white (W) pixels forming a single unit-pixel during the sensing period (SP). However, performing sensing on all of the pixels takes long time, and consumes more power.

To prevent such a problem, the display device 1 in the aspect performs sensing on the representative pixel only among the pixels (R, G, B, W) forming the unit-pixel during the sensing period (SP) and compensates for data voltage corresponding to a result of the sensing. At this time, the display device 1 may perform compensation to the remaining pixels by applying the offset value to the compensation value of the representative pixel, thereby shortening the sensing time.

In the aspect, the representative pixel may be, for example, one of the pixels disposed far from the sensing line (SL). For example, the representative pixel may be the white pixel (W), but is not limited thereto. As it gets distanced from the sensing line (SL), sensing accuracy may decrease when an indirect pixel sensing is applied. Therefore, according to the aspect, the display device may perform pixel sensing directly by designating a pixel positioned far from the sensing line (SL) as the representative pixel, and may compensate for the data voltage indirectly to the pixels positioned closer to the sensing line (SL) based on the sensing result of the representative pixel in order to increase sensing accuracy.

The display device 1 may perform sensing on the entire pixels (R, G, B, W) according to the predetermined conditions, and calibrate the offset value, thereby improving sensing accuracy.

Hereinafter, driving method of the display device 1 will be explained in detail.

Figure 5:
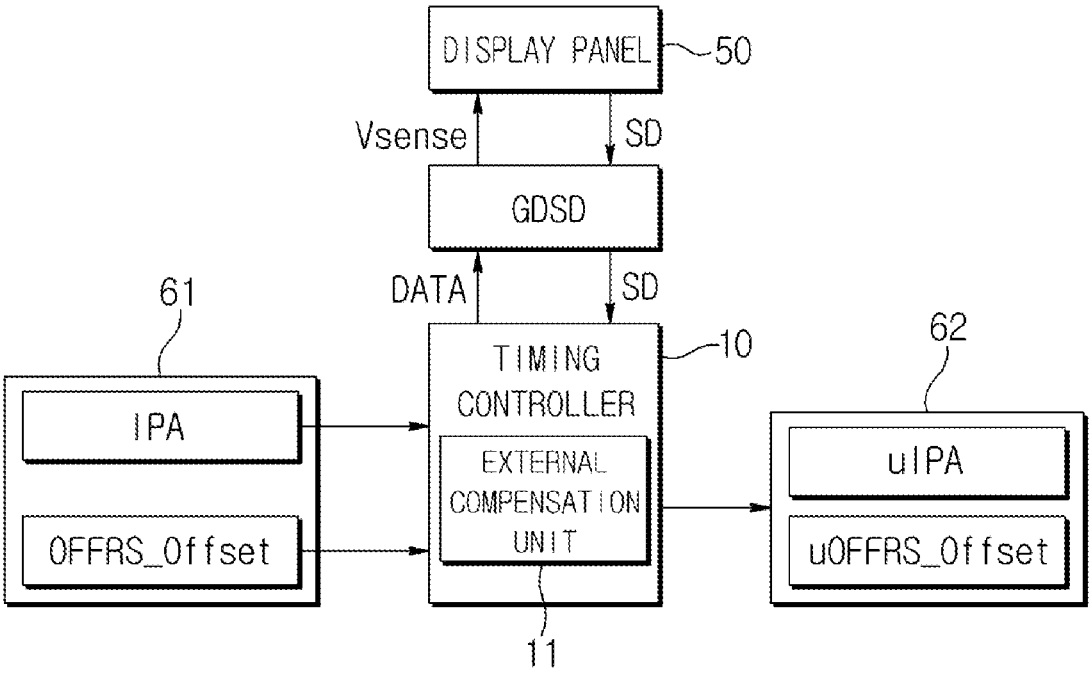
FIG. 5 is a diagram that schematically shows configuration of the display device according to an aspect of the present disclosure.

FIG. 5 is a diagram that schematically shows configuration of the display device according to an aspect of the present disclosure.

Referring to FIG. 5, the display device 1 may include drivers (GDSD), the timing controller 10, the display panel 50 and a first storage unit 61 and a second storage unit 62.

The drivers (GDSD) are the ones to drive the display panel 50 and may include the gate driver 20, the data driver 30 and the sensing unit 40. The drivers (GDSD) may generate the data voltage (Vdata) based on the video data inputted from the timing controller 10 and apply the video data to the display panel 50. During the sensing period, the drivers (GDSD) may apply the sensing data voltage (Vsense) to the display panel 50. The drivers (GDSD) may generate the sensing data based on currents received from the display panel 50 during the sensing period, and deliver it to the timing controller 10.

The timing controller 10 may include the external compensation unit 11. The external compensation unit 11 may analyze change in an electrical characteristic of the pixels (PX) based on the sensing data (SD) received from the drivers (GDSD) and generate the external compensation data according to the analysis. Thereafter, the timing controller 10 may calibrate the video data based on the external compensation data generated by the external compensation unit 11 and deliver the calibrated video data to the drivers (GDSD).

The first storage unit 61 may store the external compensation data. The external compensation data may include, for example, the threshold voltage data (IPA) and the offset data (OFFRS_Offset). The threshold voltage data (IPA) may include a threshold voltage of the driving transistor for each of the red (R), green (G), blue (B) and white (W) pixels. The offset data (OFFRS_Offset) may represent a difference between the compensation value of the representative pixel and that of the remaining pixels in a pixel unit. Or, the offset data (OFFRS_Offset) may represent a difference between an electrical characteristic (for example, a threshold voltage) of the representative pixel and that of the remaining pixels in a pixel unit. In the aspect, the representative pixel may be the white pixel (W), but is not limited thereto.

The external compensation data being stored in the first storage unit 61 is a data from the initial stage of driving the display panel 50 and is a value measured before the pixel deterioration occurs, for example, may be recorded when the display device 1 is being manufactured. If performing the external compensation at the initial stage of driving the display panel 50, the timing controller 10 may compensate for the video data by loading the external compensation data stored in the first storage unit 61.

In the aspect, the first storage unit 61 may be a non-volatile memory that is not reset even if the power is turned off, for example, may be an NAND flash memory, but is not limited thereto.

The second storage unit 62 may store the external compensation data updated corresponding to use of the display panel 50. The updated external compensation data may include, for example, updated threshold voltage data (uIPA) and updated offset data (uOFFRS_Offset).

The timing controller 10 may generate the external compensation data updated based on the sensing data (SD) obtained during the sensing period and the external compensation data stored in the first storage unit 61. For example, the timing controller 10 may generate updated threshold voltage data (uIPA) and an updated offset data (uOFFRS_Offset) obtained by summing the offset value and the threshold voltage recorded in the sensing data (SD) and the offset data (OFFRS_Offest) and the threshold voltage data (IPA) stored in the first storage unit 61. The timing controller 10 may record the updated external compensation data in the second storage unit 62 in real time.

In the aspect, the timing controller 10 may update the updated external compensation data as the compensation data in the first storage unit 61. In the aspect, the timing controller 10 may store the updated external compensation data in the second storage unit 62 when a difference between the external compensation data stored in the first storage unit 61 and the updated external compensation data is equal to or higher than the predetermined threshold value.

After updating the external compensation data, the timing controller 10 may load the external compensation data stored in the second storage unit 62 and compensate for the video data.

In the aspect, the second storage unit 62 is a non-volatile memory that is reset when the power is turned off, for example, may be DDR (Double data rate synchronous dynamic random-access of memory) but is not limited thereto.

In FIG. 5, the aspect where the first storage unit 61 and the second storage unit 62 are disposed on the outside of the timing controller 10 and exchange data with the timing controller in IC communication method and the like is illustrated. However, the aspect is not limited thereto, and at least some portion of the first storage unit 61 and the second storage unit 62 may be embedded to the timing controller 10.

Figure 6:
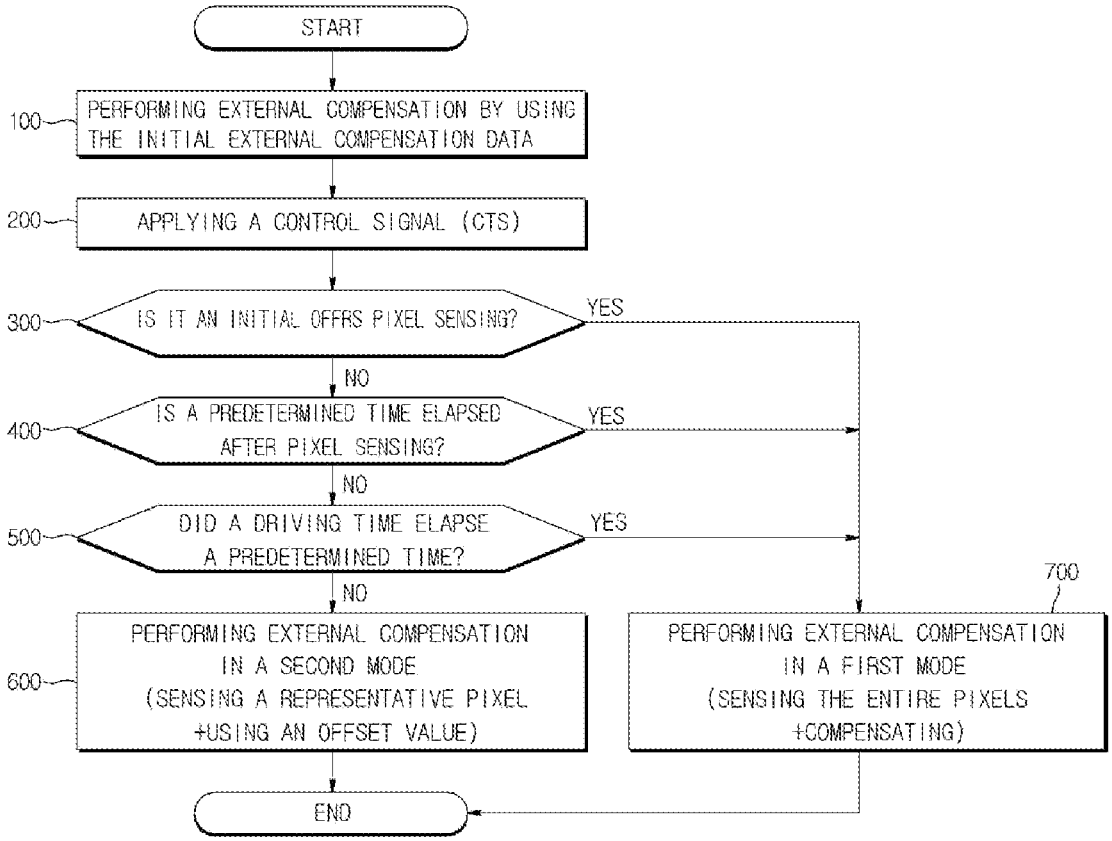
FIG. 6 is a flowchart that shows driving method of the display device according to an aspect of the present disclosure.

FIG. 6 is a flowchart that shows driving method of the display device according to an aspect of the present disclosure.

Referring to FIG. 6, at an initial driving of the display device 1, the display device 1 may perform external compensation using the initial external compensation data 100. For example, the display device 1 may load the external compensation data stored in the first storage unit 61 of FIG. 5 and calibrate the video data, and apply the calibrated video data to pixels (PX).

Thereafter, the control signal (CTS) to perform pixel sensing may be applied 200. The control signal (CTS) may be the OFFRS signal that is generated when the display device 1 is powered off. The display device 1 may perform the power-off sequence in response to the OFFRS signal. A power-off sequence period may include the sensing period. The display device 1 may sense change in an electrical characteristic of the pixels (R, G, B, W) during the sensing period.

In the aspect, when pixel sensing according to the OFFRS signal is performed for the first time 300, the display device 1 may perform the external compensation according to the first mode 700. The display device 1 may sense change in an electrical characteristic of the pixels, the red (R), green (G), blue (B) and white (W) pixels and may compensate for the data voltage for each of the pixels according to a result of the sensing.

If pixel sensing according to the OFFRS signal is performed not for the first time, the display device 1 may determine whether the predetermined condition is met or not. For example, the display device 1 may determine whether the predetermined time is elapsed or not, after the last pixel sensing is performed 400. In this instance, the predetermined time may be twenty-four hours but is not limited thereto.

And/or, the display device 1 may determine whether the driving time of the display device 1 elapsed the predetermined time or not 500. In this instance, the predetermined time may be, for example, two hundred to two hundred forty hours, but is not limited thereto.

If the predetermined condition mentioned above is not met, the display device 1 may perform the external compensation according to the first mode 700. If the external compensation according to the first mode has been performed before, the display device 1 may update the external compensation data stored before with the latest external compensation data. For example, if a difference between the external compensation data stored before and the external compensation data according to the current sensing result is equal to or more than the predetermined threshold value, the display device 1 may update the external compensation data stored before with the value according to the current sensing result.

On the other hand, if predetermined condition is met, the display device 1 may perform the external compensation according to the second mode 600. In the second mode, the display device 1 may perform sensing on one representative pixel among the red (R), green (G), blue (B) and white (W) pixels. Here, in the shared structure as illustrated in FIG. 3, the representative pixel may be one among those disposed far from the sensing line (SL). For example, the representative pixel may be the white pixel (W), but is not limited thereto.

The display device 1 may compensate for the data voltage to the representative pixel according to the sensing result. The display device 1 may compensate for the data voltage to the remaining pixels by using the offset data.

As explained above, in the aspect, the display device 1 may perform pixel sensing only for the representative pixel in the pixel unit, and perform external compensation to the entire pixels using the offset data stored before. Thereby, the display device 1 may shorten the sensing period and reduce power consumption during the sensing period. In the meantime, in the aspect, the display device 1 may improve sensing accuracy by performing pixel sensing on the entire pixels according to the predetermined condition and/or predetermined cycles and updating the external compensation data.

Hereinafter, pixel sensing in the first mode and the second mode and method of the external compensation will be explained.

Figure 7:
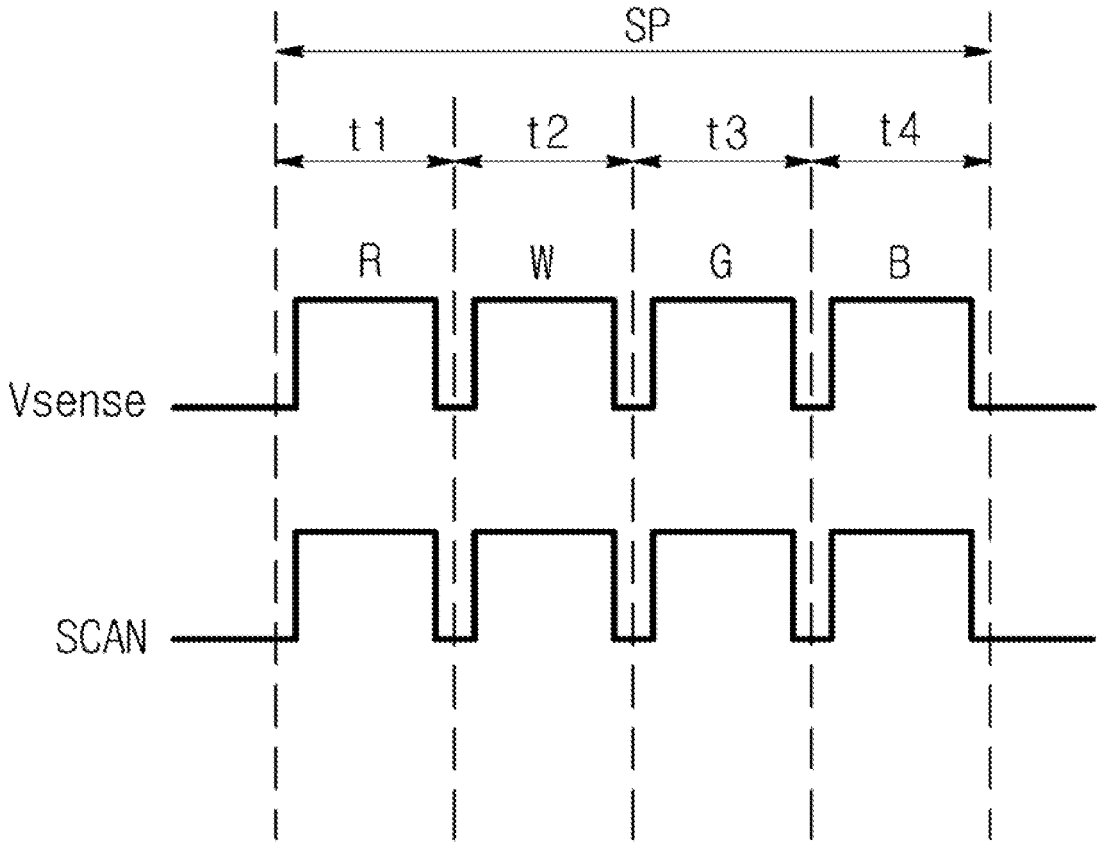
FIG. 7 is a timing diagram that shows driving method of the display device in a first mode of the present disclosure.

FIG. 7 is a timing diagram that shows driving method of the display device in a first mode of the present disclosure.

Referring to FIG. 7, the display device 1 performs pixel sensing on red (R), green (G), blue (B) and white (W) pixels of a pixel unit in the first mode.

During a first period (t1) of the sensing period (SP), the display device 1 applies the sensing data voltage (Vsense) and the sensing gate signal (SSCAN) to the red pixel (R). In addition, the display device 1 may generate the sensing data (SD) by sensing current received from the red pixel (R) via the sensing line (SL).

Thereafter, during a second period (t2) of the sensing period, the display device 1 applies the sensing data voltage (Vsense) and the sensing gate signal (SSCAN) to the white pixel (W). Further, the display device 1 may generate the sensing data (SD) by sensing current received from the white pixel (W) via the sensing line (SL).

Thereafter, during a third period (t3) of the sensing period, the display device 1 applies the sensing data voltage (Vsense) and the sensing gate signal (SSCAN) to the green pixel (G). Further, the display device 1 may generate the sensing data (SD) by sensing current received from the green pixel (G) via the sensing line (SL).

Thereafter, during a fourth period (t4) of the sensing period, the display device 1 applies the sensing data voltage (Vsense) and the sensing gate signal (SSCAN) to the blue pixel (B). Further, the display device 1 may generate the sensing data (SD) by sensing current received from the blue pixel (B) via the sensing line (SL).

Figure 8:
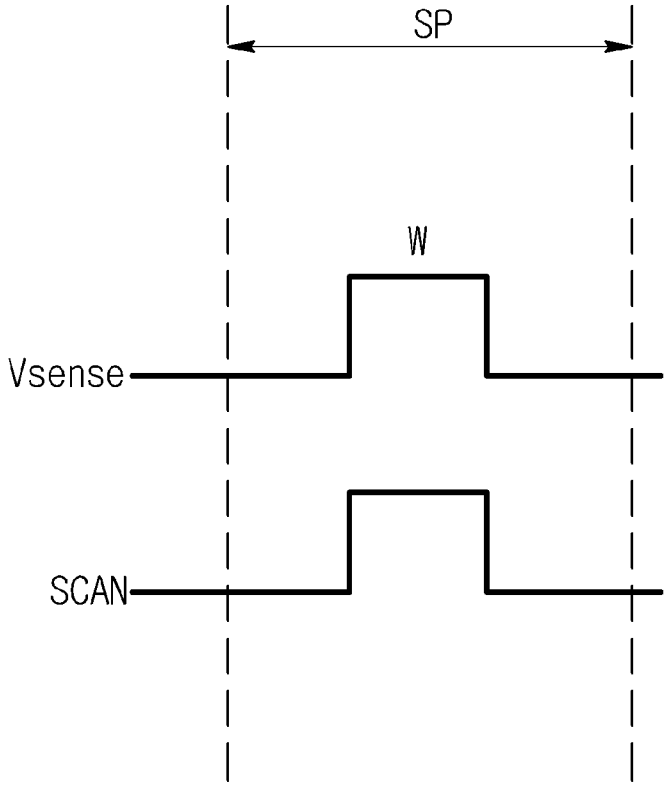
FIG. 8 is a timing diagram that shows driving method of the display device in a second mode of the present disclosure.

FIG. 8 is a timing diagram that shows driving method of the display device in a second mode of the present disclosure.

Referring to FIG. 8, the display device 1 performs pixel sensing on one representative pixel among the red (R), green (G), blue (B) and white (W) pixels of a pixel unit in the second mode.

During the sensing period, the display device 1 applies the sensing data voltage (Vsense) and the sensing gate signal (SSCAN) to the white pixel (W) that is the representative pixel. In addition, the display device 1 may generate the sensing data (SD) by sensing current received from the white pixel (W) via the sensing line (SL). The display device 1 may generate the offset data that is a difference between compensation values based on the threshold voltage difference for the remaining pixels (R, G, B).

The display device and driving method of the same according to the aspects of the present disclosure may shorten sensing time of the driving transistor.

Further, the display device and driving method of the same according to the aspects of the present disclosure may prevent deterioration and non-uniformity of luminance that is caused by deterioration in pixels and may improve image quality.

Those skilled in the art may understand that the present disclosure described herein may be implemented in other concrete forms without departing from the technical concept or essential features thereof. Thus, it should be understood that aspects described hereinabove are examples in all aspects, and do not limit the present disclosure. The scope of the present disclosure will be denoted by the claims that are provided hereinbelow, rather than the detailed description. In addition, it should be construed that all modifications or variations that are derived from the meaning, scope and the concept of equivalence of the claims are covered in the scope of the present disclosure.

What is claimed is:

1. A method of driving a display device comprising a display panel, wherein the display panel has unit-pixels disposed thereon, and each of the unit-pixels is formed of a plurality of pixels, the method comprising:

applying data voltage to the plurality of pixels during a display period;

applying sensing data voltage to the plurality of pixels during a sensing period;

sensing an electrical characteristic of the plurality of pixels based on current outputted from the plurality of pixels in response to the sensing data voltage; and compensating for the data voltage based on the sensing result, wherein the plurality of pixels disposed in a same row and forming a unit-pixel share one sensing line, wherein the sensing an electrical characteristic of the plurality of pixels comprises performing the sensing on each of the plurality of pixels in a first mode and performing the sensing on a representative pixel of the plurality of pixels which is disposed far from the sensing line in a direction of the row in a second mode, and wherein the compensating for the data voltage based on the sensing result comprises compensating for the data voltage based on results of sensing each of the plurality of pixels in the first mode and compensating for the data voltage by using a result of sensing the representative pixel and an offset data corresponding to a difference between an electrical characteristic of the representative pixel and an electrical characteristic of remaining pixels in the second mode.

2. The method of driving the display device of claim 1, wherein the sensing an electrical characteristic of the plurality of pixels comprises determining whether the sensing is performed for the first time or not and proceeding to the first mode if the sensing is performed for the first time.

3. The method of driving the display device of claim 2, wherein the sensing an electrical characteristic of the plurality of pixels comprises determining whether a predetermined condition is met or not if the sensing is performed not for the first time, proceeding to the second mode if the predetermined condition is not met, and proceeding to the first mode if the predetermined condition is met.

4. The method of driving the display device of claim 3, wherein the predetermined condition is a case that a first predetermined time is elapsed after a last sensing, or a case that a driving time of the display device elapsed a second predetermined time.

5. The method of driving the display device of claim 1, further comprising:

storing an initial external compensation data of the display device in a first memory before the applying the sensing data voltage to the plurality of pixels during the sensing period; and storing an updated external compensation data obtained by summing the sensing result and the initial external compensation data in a second memory after the sensing an electrical characteristic of the plurality of pixels.

6. The method of driving the display device of claim 5, wherein the external compensation data comprises threshold voltage data of a driving transistor provided in each of the plurality of pixels and an offset data representing a difference in an electrical characteristic of the driving transistors of the plurality of pixels.

7. The method of driving the display device of claim 1, wherein the applying the sensing data voltage to the plurality of pixels during the sensing period comprises outputting an OFFRS signal at a turn-on level as a response to a power-off request and applying the sensing data voltage to the plurality of pixels while the OFFRS signal is maintained at the turn-on level.

8. A display device comprising:

a display panel with a plurality of pixels disposed thereon, each of the plurality of pixels being formed of a plurality of pixels;

a data driver applying data voltage to the plurality of pixels during a display period and applying sensing data voltage to the plurality of pixels during a sensing period;

a sensing unit sensing an electrical characteristic of the plurality of pixels during the sensing period; and an external compensation unit compensating for the data voltage based on a result of the sensing, wherein the plurality of pixels disposed in a same row in the display panel and forming a unit-pixel share one sensing line, wherein the sensing unit is configured to perform the sensing on each of the plurality of pixels in a first mode and perform the sensing on a representative pixel of the plurality of pixels which is disposed far from the sensing line in a direction of the row in a second mode, and wherein the external compensation unit is configured to compensate for the data voltage based on results of sensing each of the plurality of pixels in the first mode, and compensate for the data voltage by using a result of sensing the representative pixel and an offset data corresponding to a difference between an electrical characteristic of the representative pixel and an electrical characteristic of remaining pixels in a second mode.

9. The display device of the claim 8, wherein the sensing unit is configured to perform the sensing according to the first mode when the sensing is performed for the first time, perform the sensing according to the second mode when the sensing is performed not for the first time, and perform the sensing according to the first mode when a predetermined condition is met.

10. The display device of claim 9, wherein the predetermined condition is a case that a first predetermined time is elapsed after a last sensing, or a case that a driving time of the display device elapsed a second predetermined time.

11. The display device of claim 8, further comprising:

a first memory storing an initial external compensation data of the display device; and a second memory storing an updated external compensation data obtained by summing the sensing result and the initial external compensation data.

12. The display device of claim 11, wherein the external compensation data comprises threshold voltage data of a driving transistor provided in each of the plurality of pixels and an offset data representing a difference in an electrical characteristic of the driving transistors of the plurality of pixels.

13. The display device of the claim 8, wherein the sensing period is a turn-on period of an OFFRS signal being generated when power of the display device is turned off.

* * * * *